US011680471B2

(12) United States Patent
Al-Gouhi

(10) Patent No.: US 11,680,471 B2
(45) Date of Patent: Jun. 20, 2023

(54) LIFTING HYDROCARBONS IN STAGES WITH SIDE CHAMBERS

(71) Applicant: Saudi Arabian Oil Company, Dhahran (SA)

(72) Inventor: Al-Waleed Abdullah Al-Gouhi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 179 days.

(21) Appl. No.: 17/188,782

(22) Filed: Mar. 1, 2021

(65) Prior Publication Data

US 2022/0275711 A1 Sep. 1, 2022

(51) Int. Cl.

| | |
|---|---|
| ***E21B 43/12*** | (2006.01) |
| ***E21B 47/047*** | (2012.01) |
| ***E21B 34/16*** | (2006.01) |

(52) U.S. Cl.

CPC ..... *E21B 43/122* (2013.01); *E21B 34/16* (2013.01); *E21B 47/047* (2020.05); *E21B 2200/04* (2020.05)

(58) Field of Classification Search

CPC ..... E21B 43/122; E21B 34/16; E21B 47/047; E21B 2200/04; E21B 43/123

See application file for complete search history.

(56) References Cited

U.S. PATENT DOCUMENTS

| | | | | |
|---|---|---|---|---|
| 1,294,069 | A | 2/1919 | English | |
| 1,390,085 | A | 9/1921 | Salvatore | |
| 1,719,589 | A * | 7/1929 | Carlisle | E21B 43/123 417/116 |
| 2,016,433 | A | 10/1935 | Humason | |
| 2,131,183 | A | 9/1938 | Key | |
| 2,864,317 | A | 12/1958 | Robinson | |
| 3,736,983 | A | 6/1973 | Beard et al. | |
| 4,653,989 | A | 3/1987 | Mason et al. | |

(Continued)

FOREIGN PATENT DOCUMENTS

| | | |
|---|---|---|
| WO | 9964742 | 12/1999 |

OTHER PUBLICATIONS

EPO Communication Pursuant to Article 94(3) EPC in European Appln. No. 19718023.5, dated Aug. 8, 2022, 5 pages.

(Continued)

*Primary Examiner* — Jonathan Malikasim
(74) *Attorney, Agent, or Firm* — Fish & Richardson P.C.

(57) ABSTRACT

A production tubing is disposed in a wellbore. Hydrocarbons entrapped in a subterranean zone enter the wellbore. Multiple valves are disposed in the production tubing at respective multiple tubing locations. The multiple valves divide the production tubing into multiple stages. A presence of hydrocarbons in a first stage terminating at a first valve is determined and gas is injected into the first stage causing the hydrocarbons in the first stage to flow uphole through the first valve into a second stage uphole of the first stage. It is determined that the second stage is filled with the hydrocarbons and injection of the gas into the first stage is ceased. Multiple side chambers are disposed in the respective multiple stages. Determining the presence of hydrocarbons in the first stage incudes detecting a fluidic level of the hydrocarbons inside the first side chamber.

19 Claims, 11 Drawing Sheets

(56) References Cited

U.S. PATENT DOCUMENTS

| | | | | |
|---|---|---|---|---|
| 6,435,838 | B1 * | 8/2002 | Marvel | F04F 1/12 417/244 |
| 6,558,128 | B2 | 5/2003 | Marvel et al. | |
| 6,672,392 | B2 | 1/2004 | Reitz | |
| 6,810,961 | B2 | 11/2004 | Marvel et al. | |
| 7,793,727 | B2 * | 9/2010 | Gaudette | E21B 34/08 166/372 |
| 10,941,639 | B2 * | 3/2021 | Al-Gouhi | E21B 43/122 |
| 2019/0316451 | A1 * | 10/2019 | Al-Gouhi | E21B 47/06 |

OTHER PUBLICATIONS petrowiki.org [online], "Plunger Lift," PetroWiki, SPE International, available on or before Jun. 30, 2015, retrieved on Apr. 5, 2019, retrieved from URL <https://petrowiki.org/Plunger_lift>, 6 pages.

petrowiki.org [online], "Gas Lift," PetroWiki, SPE International, available on or before Jul. 1, 2015, retrieved on Apr. 5, 2019, retrieved from URL <https://petrowiki.org/Gas_lift>, 4 pages.

GCC Examination Report in GCC Appln. No. GC 2019-37354, dated Dec. 21, 2020, 4 pages.

PCT International Search Report and Written Opinion in International Appln. No. PCT/US2019/025280, dated Jul. 12, 2019, 13 pages.

* cited by examiner

LIFTING HYDROCARBONS IN STAGES WITH SIDE CHAMBERS

TECHNICAL FIELD

This disclosure relates to producing hydrocarbons, for example, oil, gas or combinations of them, through wellbores.

BACKGROUND

Hydrocarbons, for example, oil, gas, combinations of them, or other hydrocarbons, can be entrapped in subterranean zones, which can include a formation, multiple formation or portions of a formation. Wellbores can be drilled in the subterranean zone to recover entrapped hydrocarbons. A primary recovery technique to recover the entrapped hydrocarbons is based on a natural pressure exerted by the subterranean zone. The natural pressure causes the hydrocarbons to flow into a wellbore and to a surface of the wellbore. Over time, however, the natural pressure can decrease. In such situations, secondary recovery techniques can be implemented to flow (that is, to lift or raise) the hydrocarbons to the surface. Some examples of secondary recovery techniques can include the use of electric submersible pumps (ESPs) that can receive the hydrocarbons at a downhole (or upstream) location and flow the hydrocarbons to an uphole (or downstream) location.

SUMMARY

Certain aspects of the subject matter described here can be implemented as a method. A production tubing is disposed in a wellbore formed in a subterranean zone. The production tubing extends from a surface of the wellbore to a downhole location in the wellbore at which hydrocarbons entrapped in the subterranean zone enter the wellbore. Multiple valves are disposed in the production tubing at respective multiple tubing locations. Each valve is configured to permit one-way flow of hydrocarbons in an uphole direction. The multiple valves divide the production tubing into multiple stages. A stage is a portion of the production tubing between two successively disposed valves. A presence of hydrocarbons in a first stage terminating at a first valve is determined. In response to determining the presence of hydrocarbons in the first stage, gas is injected into the first stage causing the hydrocarbons in the first stage to flow uphole through the first valve into a second stage uphole of the first stage. It is determined that the second stage is filled with the hydrocarbons flowed uphole through the first valve from the first stage. In response to determining that the second stage is filled with the hydrocarbons, injection of the gas into the first stage is ceased. Multiple side chambers are disposed in the respective multiple stages, with each side chamber fluidically coupled to a respective stage. Each side chamber receives hydrocarbons from the respective stage. Each side chamber has one or more sensors coupled to the side chamber. Determining the presence of hydrocarbons in the first stage incudes detecting, by at least one of 1) a first sensor coupled to a first side chamber at the first stage or 2) a second sensor coupled to a second side chamber at the second stage, a fluidic level of the hydrocarbons inside the first side chamber or a fluidic level of the hydrocarbons inside the second side chamber, respectively.

In some implementations, in response to determining that the second stage is filled with the hydrocarbons, gas is injected into the second stage causing the hydrocarbons in the second stage to flow uphole through the second valve into a third stage uphole of the second stage. The third stage terminates at a third valve. It is determined that the third stage is filled with the hydrocarbons flowed uphole through the second valve from the second stage. In response to determining that the third stage is filled with the hydrocarbons, injection of the gas into the second stage is ceased.

In some implementations, the method also includes, in response to determining that the second stage is filled with the hydrocarbons, injecting gas into the second stage. Injecting gas into the second stage causes the hydrocarbons in the second stage to flow uphole through the second valve into a third stage uphole of the second stage. The third stage terminates at a third valve. The method also includes determining that the third stage is filled with the hydrocarbons flowed uphole through the second valve from the second stage. The method also includes, in response to determining that the third stage is filled with the hydrocarbons, ceasing to inject the gas into the second stage.

In some implementations, the one or more sensors include a first group of sensors coupled to the first side chamber that is fluidically coupled to the first stage. Each sensor of the first group of sensors is spaced along a length of the first side chamber. A first sensor of the first group of sensors detects a first fluidic level of the hydrocarbons in the first side chamber, and a last sensor of the first group of sensors detects a second fluidic level of the hydrocarbons in the first side chamber greater than the first fluidic level. Determining the presence of hydrocarbons in the first stage includes detecting, by the last sensor, the second fluidic level of the hydrocarbons in the first side chamber. In some implementations, determining a presence of hydrocarbons in the first stage includes determining that the first stage is full with hydrocarbon. Determining that the first stage is full with hydrocarbons includes detecting, by the last sensor, the second fluidic level of the hydrocarbons in the first side chamber.

In some implementations, each stage includes a side wall of the production tubing and each side chamber includes a pocket extending from the side wall. Each pocket defines a volume between the side wall and a wall of the pocket. The side wall includes one or more fluid ports defining a fluid pathway from the respective stage to the pocket. Each pocket is fluidically isolated from a wellbore annulus around the pocket. Injecting gas into the first stage includes injecting gas into the first stage causing the hydrocarbons in the first stage to flow uphole through the first valve into the second stage and into a volume of a second pocket of the second stage. In some implementations, each pocket includes a floater disposed inside the respective volume. Each pocket includes a floater disposed inside the respective volume and configured to float on a surface of hydrocarbons inside the volume. Detecting a fluidic level of the hydrocarbons inside the first side chamber or a fluidic level of the hydrocarbons inside the second side chamber includes detecting a presence of the floater.

In some implementations, to inject the gas into the first stage, the gas is injected for a first duration of time sufficient to flow the hydrocarbons in the first stage uphole through the first valve into the second stage and a second side chamber of the second stage.

In some implementations, to determine that the second stage is filled with the hydrocarbons flowed uphole through the first valve from the first stage, a presence of hydrocarbons in a third stage uphole of the second stage and terminating at a third valve is determined.

In some implementations, a third side chamber is disposed in the third stage uphole of the second valve. To determine the presence of hydrocarbons in the third stage, the sensor disposed at the third side chamber detects a fluidic level inside the third side chamber caused by hydrocarbons flowed from the second stage through the second valve into the third stage.

In some implementations, the aspects described above can be repeated until the hydrocarbons in the first stage are flowed out of the wellbore at the surface. The aspects described above can be repeated to lift newly accumulated hydrocarbons in the first stage to the surface.

Certain aspects of the subject matter described here can be implemented as a wellbore tool assembly. A production tubing is disposed in a wellbore formed in a subterranean zone. The production tubing extends from a surface of the wellbore to a downhole location in the wellbore at which hydrocarbons entrapped in the subterranean zone enter the wellbore. Multiple valves are disposed in the production tubing at respective multiple tubing locations. Each valve is configured to permit one-way flow of hydrocarbons in an uphole direction. The multiple valves divide the production tubing into multiple stages. A stage is a portion of the production tubing between two successively disposed valves. Multiple side chambers are disposed in the respective plurality of stages. Each side chamber is fluidically coupled to a respective stage and configured to receive hydrocarbons from the stage, each side chamber includes one or more sensors coupled to the side chamber and configured to detect a fluidic level of the hydrocarbons in the respective side chamber. Multiple gas injection valves are coupled to the production tubing. Each gas injection valve is disposed in a respective stage. A controller is coupled to the multiple gas injection valves. The controller transmits signals, based on fluidic levels detected by the one or more sensors, to the plurality of gas injection valves to lift hydrocarbons flowed into the wellbore at the downhole location to the surface on a stage-by-stage basis.

In some implementations, to lift the hydrocarbons to the surface on a stage-by-stage basis, the controller is configured to perform operations that includes determining, based on fluid level information received from at least one of 1) a first sensor of the one or more sensors residing at a first side chamber of a first stage terminating at a first valve of the plurality of valves or 2) a second sensor of the one or more sensors residing at a second side chamber of a second stage extending from the first valve of a second valve of the plurality of valves, a presence of hydrocarbons in the first stage. The controller is also configured to, in response to determining the presence of hydrocarbons in the first stage, injecting gas into the first stage causing the hydrocarbons in the first stage to flow uphole through the first valve into the second stage uphole of the first stage. The second stage terminates at the second valve. The controller also determines that the second stage is filled with the hydrocarbons flowed uphole through the first valve from the first stage, and, in response to determining the presence of hydrocarbons in the second stage, ceases to inject gas into the first stage.

In some implementations, determining the presence of hydrocarbons in the first stage includes receiving, by the controller and from the first sensor, fluidic information including a first fluidic level of the hydrocarbons in the first side chamber. The fluidic information is detected by a last sensor of a group of sensors attached to the first side chamber. Determining the presence of hydrocarbons in the first stage also includes receiving, by the controller and from the second sensor, fluidic information includes second fluidic level of the hydrocarbons in the second side chamber.

In some implementations, injecting the gas into the first stage includes injecting the gas for a first duration of time sufficient to flow the hydrocarbons in the first stage uphole through the first valve into the second stage and into the second side chamber.

In some implementations, determining that the second stage is filled with the hydrocarbons flowed uphole through the first valve from the first stage includes determining a presence of hydrocarbons in a third stage uphole of the second stage and terminating at a third valve.

In some implementations, a third side chamber is disposed in the third stage uphole of the second valve. Determining the presence of hydrocarbons in the third stage includes detecting, by a sensor attached to the third side chamber, a fluidic level of hydrocarbons inside the third side chamber flowed from the second stage through the second valve into the third stage.

In some implementations, the controller performs operations including repeating steps (a), (b), (c) and (d) until the hydrocarbons in the first stage are flowed out of the wellbore at the surface.

Certain aspects of the subject matter described here can be implemented as a method. A production tubing is disposed in a wellbore formed in a subterranean zone. The production tubing extends from a surface of the wellbore to a downhole location in the wellbore at which hydrocarbons entrapped in the subterranean zone enter the wellbore. Multiple valves are disposed in the production tubing at respective multiple tubing locations. Each valve is configured to permit one-way flow of hydrocarbons in an uphole direction. The multiple valves divide the production tubing into multiple stages. A stage is a portion of the production tubing between two successively disposed valves. The method includes determining, based on a fluidic level of hydrocarbons detected by a first sensor coupled to a first side chamber coupled to the production tubing at a first stage of the multiple stages, that the hydrocarbons are carried by the first stage. Gas is injected into the first stage, causing the hydrocarbons to flow into a second stage uphole of the first stage. Gas injection into the first stage is ceased in response to determining that the hydrocarbons flowed to the second stage. After ceasing gas injection into the first stage, gas is injected into the second stage causing the hydrocarbons to flow into a third stage uphole of the second stage.

In some implementations, the method incudes, before ceasing to inject gas into the first stage, determining, by at least one of 1) a second sensor coupled to a second side chamber coupled to the production tubing at a second stage of the plurality of stages or 2) a third sensor coupled to a third side chamber coupled to the production tubing at a third stage of the plurality of stages, a second fluidic level of the hydrocarbons in the second side chamber or a third fluidic level of the hydrocarbons in the third side chamber. In some implementations, determining that the hydrocarbons are carried by the first stage includes detecting a fluidic level of the hydrocarbons in the first stage.

In some implementations, a flow back of the hydrocarbons from the second stage to the first stage is prevented after ceasing to inject the gas into the first stage.

In some implementations, a first valve at which the first stage terminates prevents the flow back of the hydrocarbons from the second stage to the first stage.

In some implementations, gas is injected into the multiple stages on a stage-by-stage basis to flow the hydrocarbons to the surface of the wellbore.

The details of one or more implementations of the subject matter described in this disclosure are set forth in the accompanying drawings and the description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure describes a multi-stage lifting process to lift hydrocarbons in a subterranean zone to a surface of a wellbore formed in the subterranean zone. For example, techniques described in this disclosure can be implemented in a producing oil well drilled into a deep reservoir with low reservoir productivity index. Reservoir productivity index is the volume of hydrocarbons delivered per unit pressure (pounds per square inch) of drawdown at the sand face. Reservoir productivity index can be measured in barrels per day per psi (bbl/d/psi). As described below, a production tubing disposed in a wellbore is divided into multiple stages. Each stage is equipped with valves, a gas lift electrical valve, and a side chamber with sensors that detect fluidic levels. The hydrocarbons at a downhole location are produced on a stage-by-stage basis. That is, the hydrocarbons are lifted from the downhole location to the surface, one stage at a time. In some implementations, the valves can be bore isolation valves that can be actively controlled, for example, hydraulically or electrically, from the surface or from within the wellbore to open or close responsive to signals from a controller (described later). In some implementations, the valves can be check valves that can open or close based on flow direction. For example, the check valves can be ball and seat valves or flapper valves. Such valves are passive. That is, they do not require signals to open or close; rather, they open or close based on flow direction. The valves are operated based on fluid levels detected inside side chambers of each stage.

Implementations of the subject matter described here can prevent hydrocarbons from falling back, that is, flowing downhole from an uphole location, due to loss of pressure in conventional gas lift operations. The gas volume used to lift the hydrocarbons can be reduced compared to conventional gas lift operations. The depth challenge encountered in sucker rod pump technology can be decreased or overcome. Also, the challenge associated with wellbore angle deviation, which prevents the application of plunger lift technology, can also be decreased or overcome. In addition, the side chambers at each stage can detect different fluid levels, which allows each stage to be filled to predetermined levels or pressures. The side chambers can be standalone components that can be integrated with other downhole equipment to determine fluid levels. In addition, because the side chambers receive fluid from the stage during dynamic conditions of the fluid, the side chambers can allow the system to operate under dynamic conditions, as opposed to sensors that detect parameters of a fluid when the fluid is substantially static.

Figure 1A:
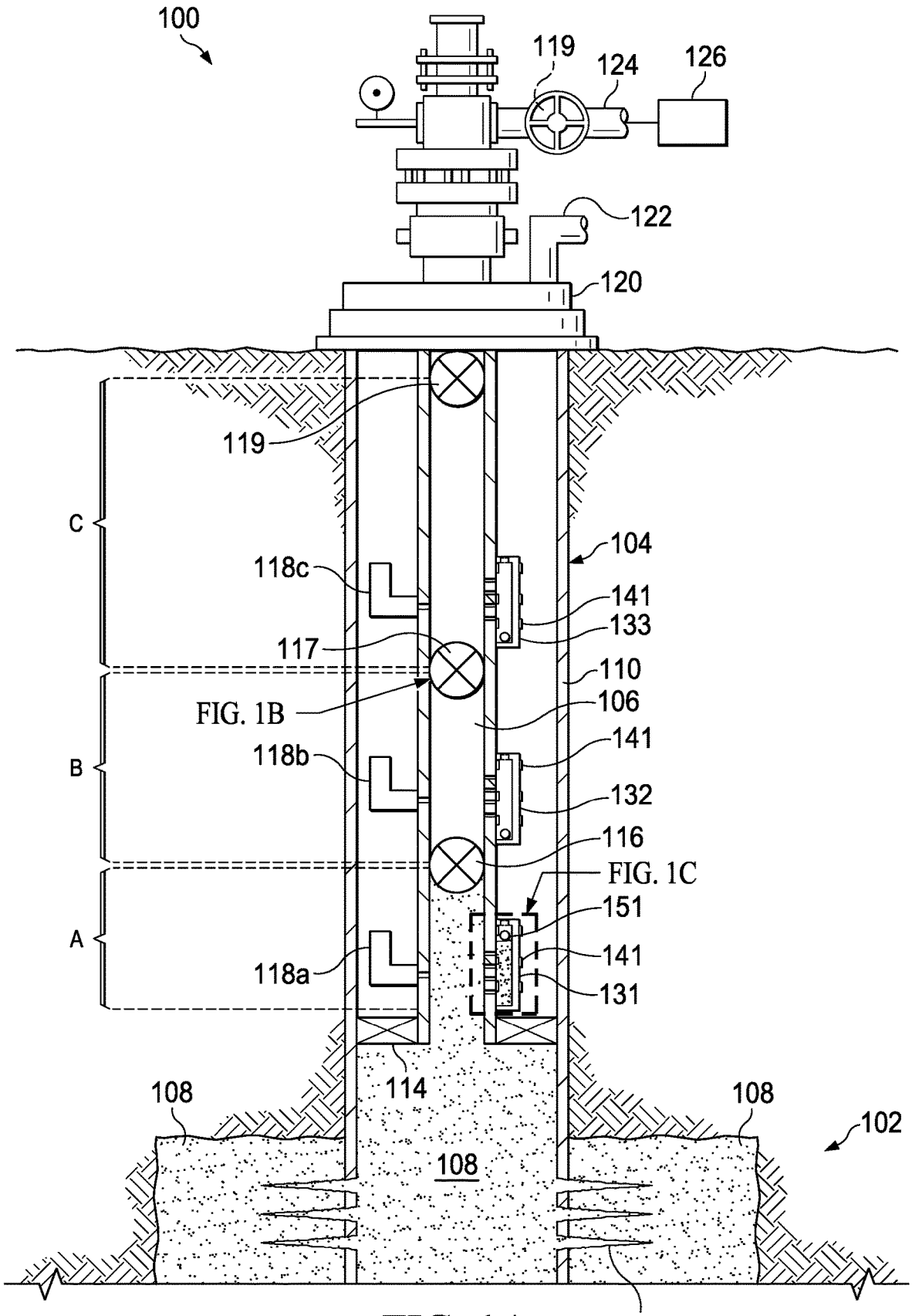
FIG. 1A is a schematic of an example of a wellbore tool system.

FIG. 1A is a schematic of an example of a wellbore tool system 100 to lift hydrocarbons entrapped in a subterranean zone 102. The subterranean zone 102 can be a formation, a portion of a formation or multiple formations. Hydrocarbons are entrapped in the subterranean zone 102. A wellbore 104 is formed in the subterranean zone 102. Production tubing 106 is disposed in the wellbore 104 in the subterranean zone 102. Hydrocarbons 108 can enter the wellbore 104 from the subterranean zone 102. In some implementations, the wellbore 104 can be cased and can include a casing 110. The cased portion (and consequently the casing 110) can span all or portions of the wellbore 104. In some implementations, perforations 112 can be formed in the casing 110 to receive the hydrocarbons 108 from the subterranean zone 102. The production tubing 106 can be disposed within the casing. Alternatively, the hydrocarbons 108 can flow into an open portion of the wellbore 104 and be received at a downhole end of the casing 110. In some implementations, an isolation mechanism 114, for example, a packer, can be installed at a downhole end of the production tubing 106 so that the hydrocarbons 108 flow into the production tubing 106 rather than into an annulus formed by the casing 110 and the production tubing 106 or by the wellbore 104 and the production tubing 106.

Figure 1B:
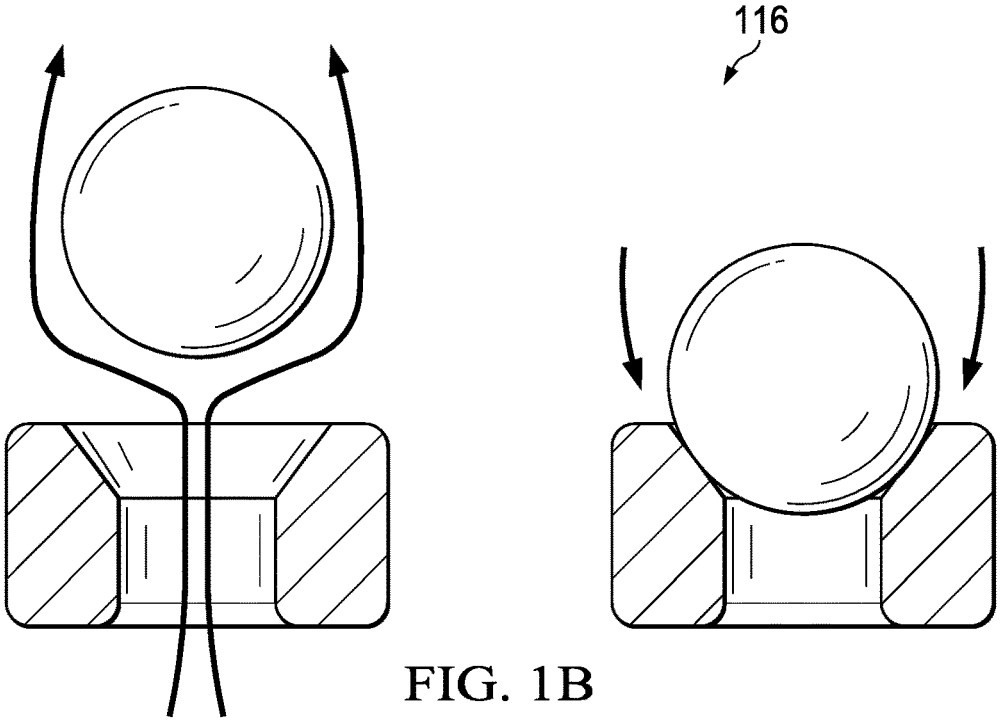
FIG. 1B is a schematic of an example of a valve used in the wellbore tool system.

The wellbore tool system includes multiple valves (for example, valves 116, 117, and 119) disposed in the production tubing 106 at respective multiple tubing locations. For example, a first valve 116 can reside downhole of a second valve 117, and second valve can reside downhole of a third valve 199. The third valve 119 can be located within the production tubing or, as indicated in FIG. 1A, at a surface (e.g., a wellhead 120) of the wellbore 104. Each valve 116 permits one-way flow of hydrocarbons in an uphole direction. FIG. 1B is a schematic of an example of a valve 116 (and 117 and 119) used in the wellbore tool system 100. The valve 116 can be a check valve that includes a ball on a seat. When hydrocarbons flow through the check valve in an uphole direction, the ball is raised from the seat in response to a fluidic pressure of the hydrocarbons being sufficient to raise the ball from the seat. When the fluidic pressure of the hydrocarbons decreases, the ball returns to the seat sealing the flow in the uphole direction. Flow of the hydrocarbons in the downhole direction is prevented by the ball being pressed against the seat in response to a fluidic pressure in the downhole direction.

The multiple valves 116, 117, and 119 can be disposed to divide the production tubing 106 into multiple stages. A stage is a portion of the production tubing 106 between two successively disposed valves. For example, a first stage 'A' can be defined between the subterranean zone 102 and the first valve 116, a second stage 'B' can be defined between the first valve 116 and the second valve 117, and the third stage can be defined between the second valve 117 and the third valve 119. In some implementations, the valves can be disposed such that the stages can have equal lengths. Alternatively, the valves can be disposed such that one stage can be longer than the other. In another implementation, some stages can be of equal length while others can be of different length. The length of each stage can depend on factors including the depth of the wellbore, the bottomhole pressure at the downhole location in the wellbore, a volume of hydrocarbons to be lifted, among others.

Multiple gas injection valves (for example, a first gas injection valve 118*a*, a second gas injection valve 118*b*, and a third injection valve 118*c*) can be coupled to the production tubing 106. Each gas injection valve is disposed in a respective stage 'A', 13', and 'C'. In some implementations, the gas injection valves can be disposed in an annulus formed by an outer surface of the production tubing 106 and the inner wall of the casing 110. In some implementations, a tubing (not shown) can be passed into the annulus, and the gas injection valves can be positioned in the tubing. An inlet 122 to flow gas to the valves 118*a*, 118*b*, and 118*c* can be provided at a surface of the wellbore 104 (e.g., at the wellhead 120). A hydrocarbon outlet 124 can be connected at the surface, for example, at the wellhead 120.

A controller 126 can be coupled to the multiple valves and the multiple gas injection valves. In some implementations, the controller 126 can be at the surface of the wellbore. In some implementations, the controller 126 can be disposed within the wellbore, for example, in the annulus formed by the production tubing 104 and the casing 110. In some implementations, the controller 126 can be implemented as a distributed computer system disposed partly at the surface and partly within the wellbore. The computer system can include one or more processors and a computer-readable medium storing instructions executable by the one or more processors to perform the operations described here. In some implementations, the controller 126 can be implemented as processing circuitry, firmware, software, or combinations of them. The controller 126 can transmit signals to the multiple valves and the multiple gas injection valves to lift hydrocarbons flowed into the wellbore at the downhole location to the surface on a stage-by-stage basis.

Multiple side chambers 131, 132, and 133 are disposed in the respective plurality of stages. The side chambers can be side pockets fixed to (e.g., welded) or otherwise mechanically attached (e.g., with mechanical fasteners) to a wall of the production tubing 106. Each side chamber is fluidically coupled to or is part of a respective stage and receives hydrocarbons from the respective stage or from the tubing 106 at the respective stage. Each side chamber has one or more sensors 141 coupled to the side chamber. For example, the sensors 141 can be attached to an external surface of the side chambers. Each side chamber has a floater 151 (e.g., a ball or other floating device) that floats at a surface the hydrocarbons inside the side chamber. The sensors 141 can detect a presence of the ball 151 to help determine a fluid level inside the side chamber. The sensors can also be used to detect when the ball does not reach the top of the side chamber to help determine that the wellbore or the production fluid are not performing optimally. For example, if a second sensor of the side chamber senses the ball but the third sensor does not, the controller can help determine that the wellbore is not producing enough hydrocarbons or that there is a faulty component (e.g., faulty injection valve or production tubing) in the system. In such cases, the controller can cause the system to stop. Additionally, the system can speed up the lift of hydrocarbons by filling each stage up to a level at which the hydrocarbons in the side chamber reach the first sensor or the second sensor (instead of waiting until the entire side chamber is full).

In some implementations, if the system is operating based on the ball reaching the top sensor (e.g., operate at level 3), and after certain period of production the reservoir performance declined and the fluid level at a stage (e.g., the bottom stage) did not reach level 3 after a predetermine period of time, the system can operate based on the ball reaching the second sensor (e.g., operate at level 2). Additionally, if the first stage is operated at level 3, and the hydrocarbons in an uphole stage (e.g., third stage) do not reach level three for a predetermined period of time, the gas injection can be started at level 2 in the uphole stage.

The sensors 141 can include any type of sensing device that is capable of detecting the presence of the ball 151 as the ball is lifted by the hydrocarbons inside the side chamber. For example, each sensors can be a ray device that each includes a ray source and a ray sensor facing the ray source. The ray source can be disposed outside the side chamber, and the ray sensor can be disposed inside the side chamber such that the ball 151 moves between the ray source and the ray sensor, and the ray sensor senses the presence of the ball 151. In some implementations, the sensors can detect a fluid level inside the side chamber absent the ball 151. For example, the sensor 141 can include a water level detector such as an external capacitance transmitter that senses an interface between water and air, or a neutron backscatter.

Figure 1C:
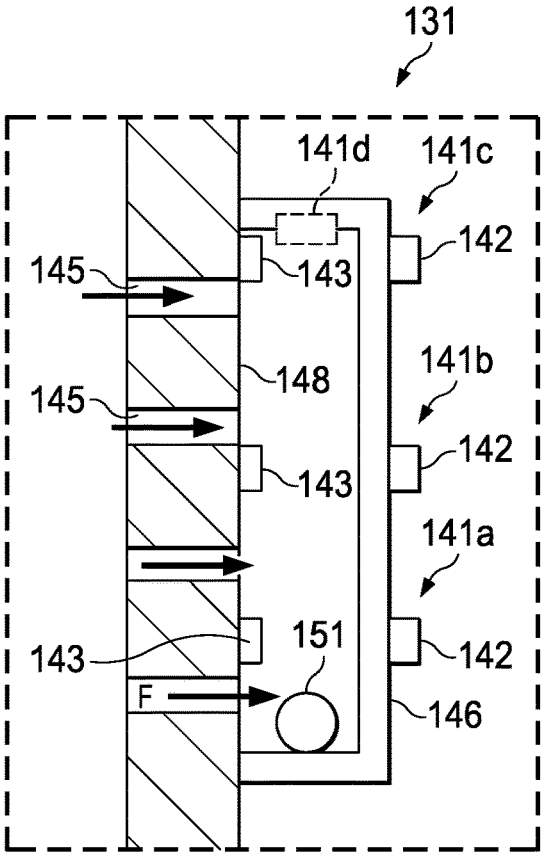
FIG. 1C is a schematic cross-sectional view of an example side chamber used in the wellbore tool system.

FIG. 1C is a schematic of an example side chamber 131 (and 132 and 133). Each side chamber can be in the form of a side pocket that extends from a side wall 148 of the production tubing 106 at each respective stage. Each side chamber defines a volume between the side wall 148 and a wall 146 of the side chamber. The side wall 148 of the production tubing includes one or more fluid ports 145 defining a fluid pathway that extends from the respective portion of production tubing to volume inside the side chamber. Each side chamber is fluidically isolated from the annulus around the pocket. The side chamber can have a length that is parallel to a length of each stage or of each tubing portion at each stage. As production fluid 'F' fills the respective stage, the production fluid 'F' flows through the fluid ports 145 into the side chamber 146. In some implementations, the fluid ports 145 includes a fluid port at a bottom end of the side chamber and a fluid port at a top end of the side chamber.

Each side chamber 131 can include a group of sensors that includes three sensors 141*a*, 141*b*, and 141*c*. Each sensor is spaced along the length of the side chamber. Each sensor includes a ray source 142 and the ray sensor 143 facing the ray source 142. The ray sensor 143 is communicatively coupled to the controller 126 at the surface of the wellbore. The ray sensor 143 can detect a presence of the ball 151 when the ball 115 is disposed between the ray sensor 143 and the ray source 142. In some implementations, a sensor 141*d* or trigger disposed inside the side chamber can detect or be activated by the ball 151 reaching the top of the side chamber to help determine that the side chamber is full.

FIGS. 2A-2H are schematics showing example operations of the wellbore tool system 100 to lift hydrocarbons 108 on a stage-by-stage basis. The example wellbore tool system 100 shown in FIGS. 2A-2H are the same as that shown in FIG. 1A. The production tubing is divided into three stages. In the example shown in FIG. 2A, hydrocarbons 108 have flowed from the subterranean zone into the first stage (that is, the most downhole stage). In some implementations, the first stage can be fully filled with the hydrocarbons 108. That is, the hydrocarbons can have filled the first stage from the bottom of the first stage to the first valve that terminates the first stage. In some implementations, the first stage can be partially filled with the hydrocarbons 108. A natural pressure differential can fill the first stage of the first gas injection valve can inject gas into the first stage to fill the first stage.

The controller can determine a presence of the hydrocarbons 108 in the first stage. The first side chamber 131 can be disposed in the first stage. The sensor or sensors of the side chamber can detect a fluidic level of the hydrocarbons inside the first side chamber 131 and transmit the sensed fluidic level to the controller. For example, the ball is lifted by the hydrocarbons to a predetermined elevation along the side chamber, and the sensor senses the presence of the ball, which can represent the fluidic level of the hydrocarbons inside the side chamber. Based on the fluidic level 131 inside the side chamber, the controller determines a presence of hydrocarbons (e.g., a fluid level or pressure) in the tubing 106 at the first stage. The controller can determine that the stage is filled with a pre-determined quantity of hydrocarbons 108 based on the detected or sensed fluid level satisfying (for example, being greater than) a threshold fluidic level. The threshold fluidic level can be, for example, a fluidic level inside the side chamber that indicates a threshold fluidic pressure inside the tubing at the first stage. In some implementations, the controller can determine that the fluidic level is satisfied in response to the sensors detecting a fluidic level for a threshold duration of time. Doing so can ensures that the sensors detect a fluidic level representative of a large hydrocarbon column and not merely a small flow of hydrocarbons.

In some implementations, a small presence of hydrocarbons in the second stage can help determine that the first stage is full. For example, determining the presence of hydrocarbons in the first stage can include detecting, by at least one of 1) a first sensor coupled to the first side chamber at the first stage or 2) a second sensor coupled to the second side chamber at the second stage, a fluidic level of the hydrocarbons inside the first side chamber or a fluidic level of the hydrocarbons inside the second side chamber, respectively. A small large level of hydrocarbons in the first side chamber and a low level of hydrocarbons in the second side chamber can together be indicative of a full first stage. For example, the controller can determine that the first stage is full when the third sensor of the first side chamber 131 detects the ball, and the first sensor 141*a* of the second side chamber 132 detects the ball of the second side chamber 132. In some implementations, the controller can determine that the first stage is full based only on the readings of the sensor(s) at the first side chamber, or based only on the readings of the sensor(s) at the second side chamber.

Figure 2A:
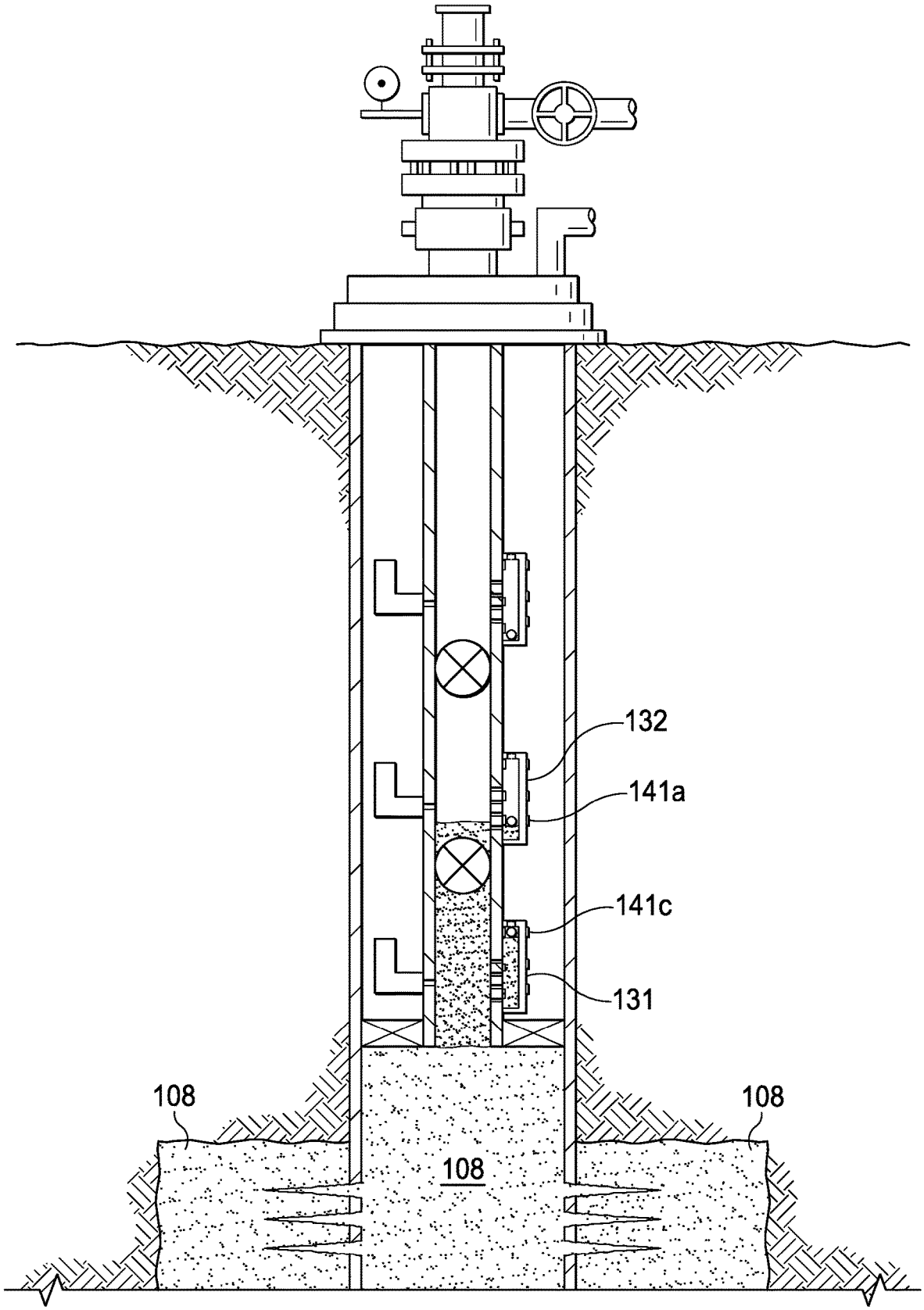
FIGS. 2A-2H are schematics showing example operations of the wellbore tool system to lift hydrocarbons.
Figure 2B:
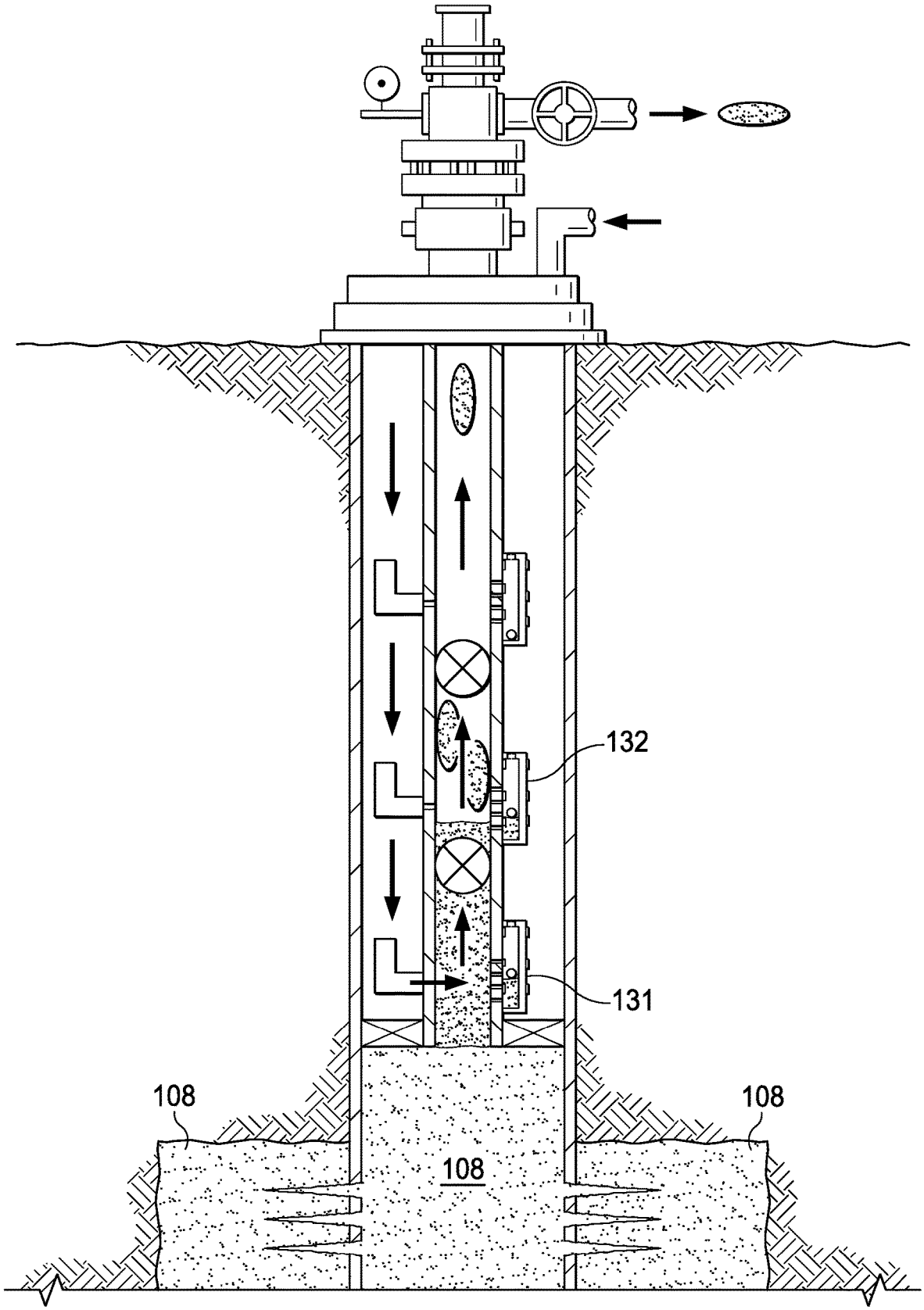

FIG. 2B shows a lifting of the hydrocarbons 108 in the first stage. In response to determining the presence of the hydrocarbons 108 in the first stage, the controller can inject gas into the gas injection valve coupled to the first stage. For example, the controller can transmit a signal to a gas source (for example, a pump coupled to a storage tank) to flow gas to the gas injection valve. At the same time, the controller can transmit a signal to open the gas injection valve. In some implementations, each gas injection valve can be connected to the bottom-most portion of a respective stage, that is, nearest to an entrance of the stage. The pressure of the gas causes the hydrocarbons 108 to rise uphole. When the rising hydrocarbons apply sufficient pressure on the first valve that terminates the first stage, the first valve opens allowing the hydrocarbons to flow uphole to the second stage. The second side chamber 132 can be disposed near the second valve (e.g., at a downhole end of the second stage). Injecting gas into the first stage causes the hydrocarbons in the first stage to flow uphole through the first valve into the second stage and into the volume of a second side chamber 132 of the second stage.

Figure 2C:
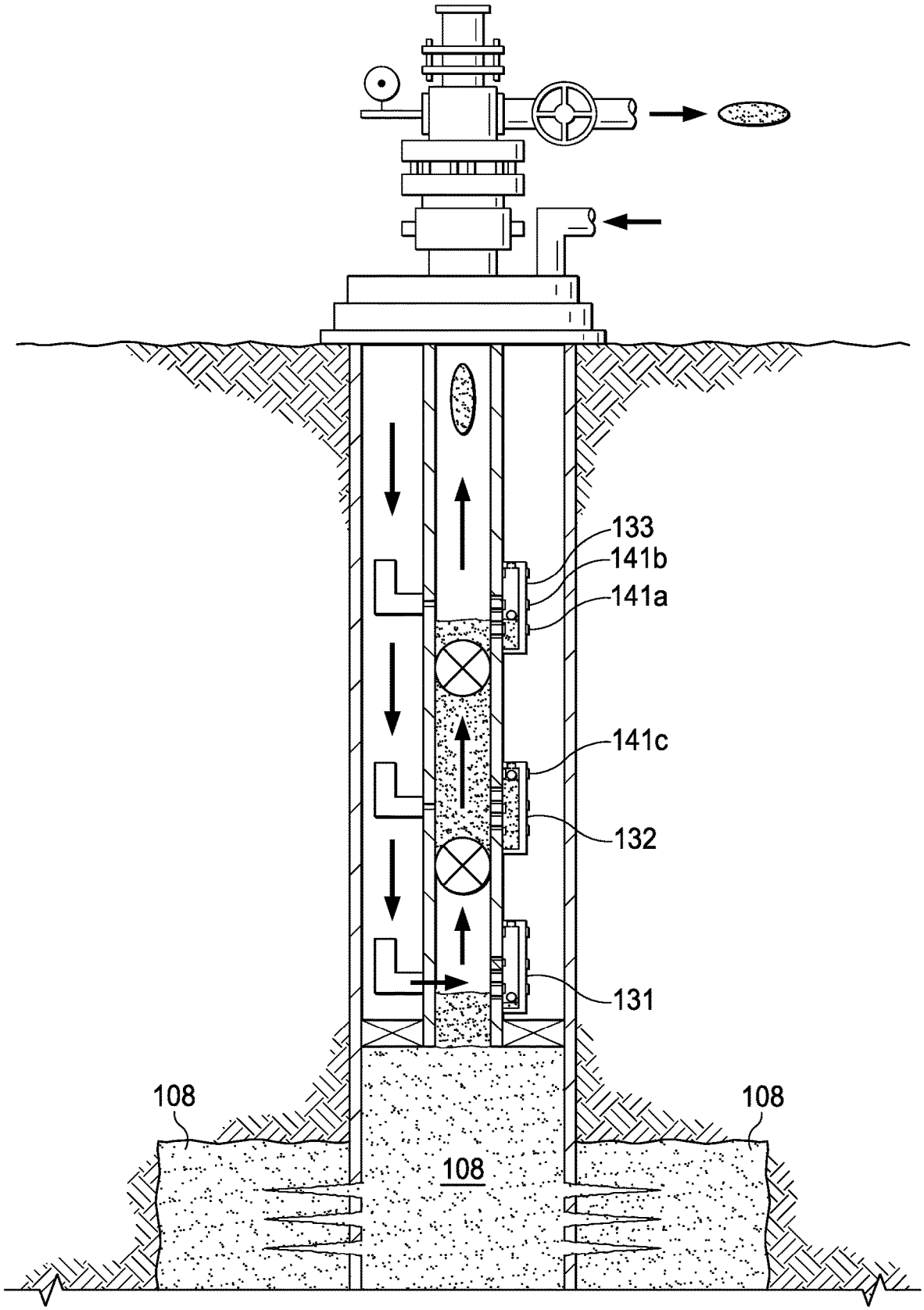

FIG. 2C shows the second stage filled with the hydrocarbons 108. As the hydrocarbons rise into the second stage, the second stage is filled with the hydrocarbons 108. The second side chamber 132 installed in the second stage is similar to the side chamber 131 in the first stage. During this filling, the gas injection valve coupled to the first stage continues to inject gas into the first stage. In some implementations, the gas injection valve can continue the gas injection for a pre-determined time period, for example, a period sufficient to lift hydrocarbons of known volume by a known distance.

Figure 2D:
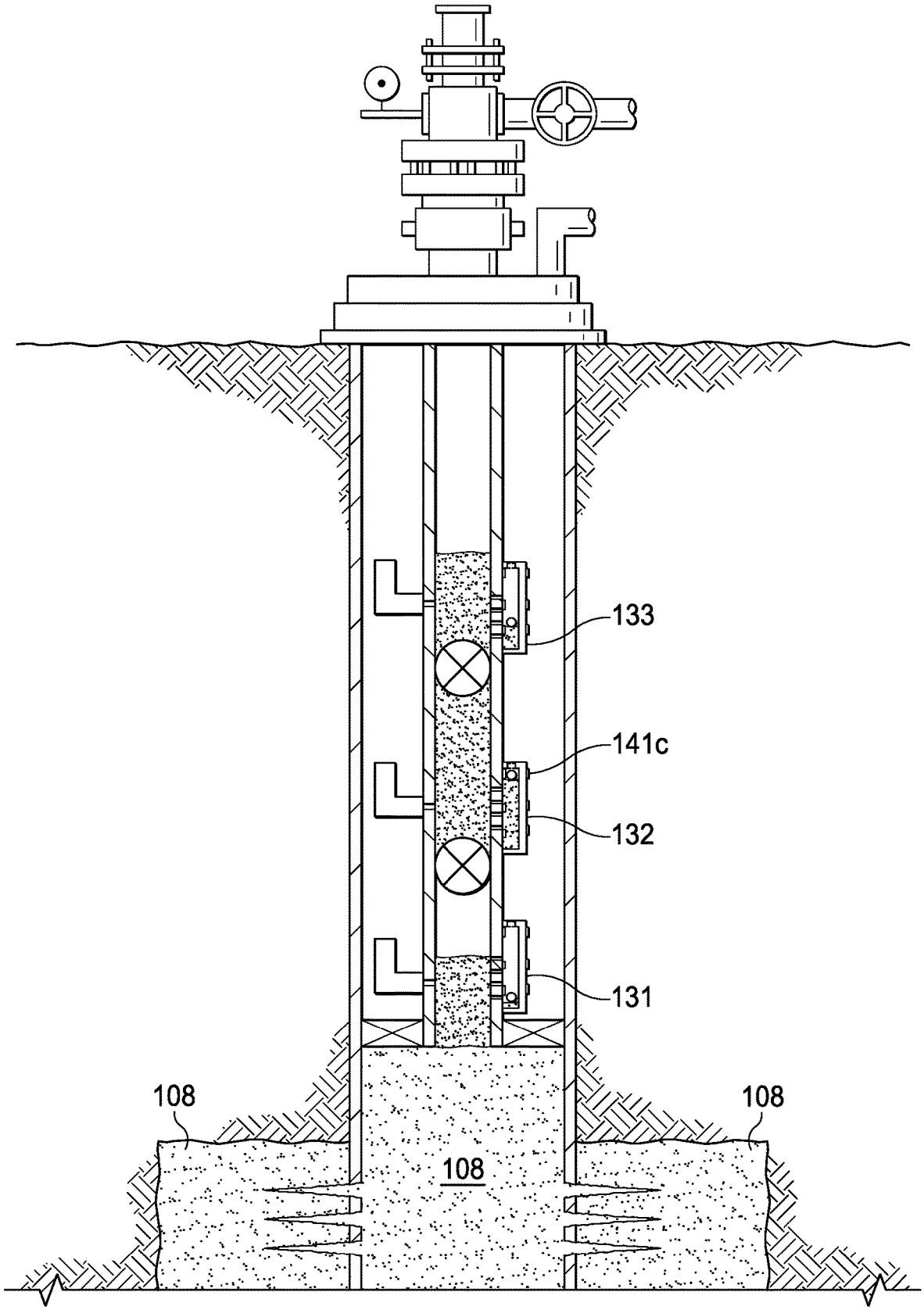

FIG. 2D shows a cessation of gas injection. After the second stage is filled with the hydrocarbons (partially or completely), the gas injection valve ceases to inject gas into the first stage. In some implementations, the controller can receive a signal from the last sensor 141*c* of the second side chamber 132, the signal representing a high fluidic level in the side chamber, which represents a fluidic pressure or level in the second stage. The fluidic level in the second side chamber 132 can indicate a volume or quantity of hydrocarbons in the second stage. In response to determining that the fluidic level detected by the sensor 141*c* in the second side chamber 132 of the second stage satisfies (for example, is greater than) a fluidic level threshold, the controller transmits a signal to cease gas injection through the first gas injection valve. Ceasing gas injection through the gas injection valve can be implemented by transmitting a signal to close the gas injection valve or to turn off the gas source or both. In some implementations, the gas source can remain on at all times and the controller can control gas injection by opening or closing the respective gas injection valves. In this manner, the column of hydrocarbons in the first stage (FIG. 2A) have been lifted to the second stage. Hydrocarbons can continue to accumulate in the first stage from the subterranean zone.

Figure 2E:
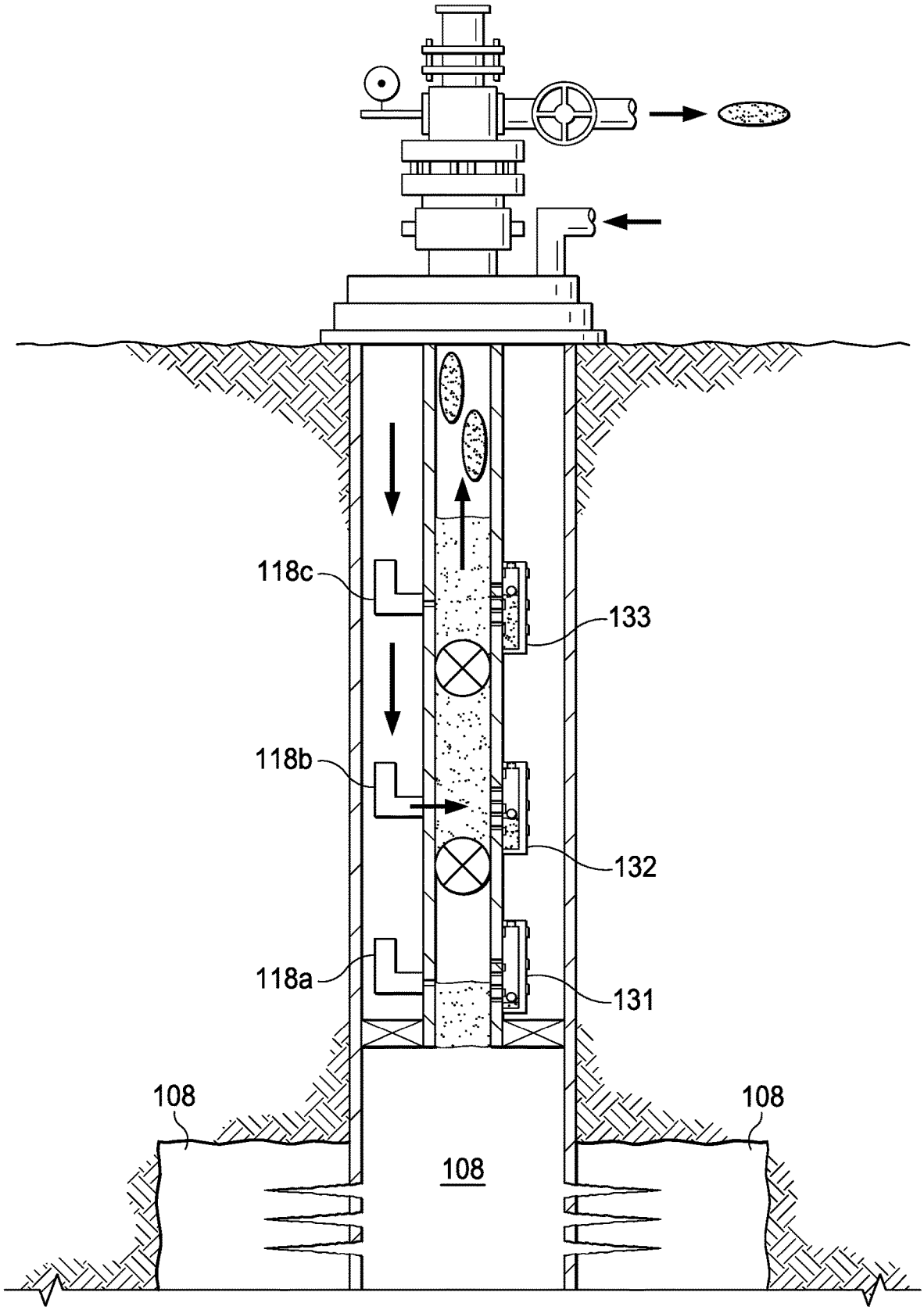

FIG. 2E shows lifting of hydrocarbons from the second stage to the third stage uphole of the second stage. As describe above, the controller can determine a presence of the hydrocarbons in the second stage based on a fluidic level by a sensor in the second side chamber of the second stage. Alternatively or in addition, as shown in FIG. 2C, the controller determines the presence of hydrocarbons in the second stage based on a fluidic level detected by a sensor of the third side chamber in the third stage. After the second stage has filled, hydrocarbons can flow uphole from the second stage into the third stage. Because the third side chamber 133 is positioned near an entrance of the third stage, the hydrocarbons enter the third side chamber 133, which triggers one or more of the sensors at the third side chamber 133. The presence of hydrocarbons in the third stage indicates that the second stage is filled (completely or partially) with hydrocarbons. In response, the controller implements techniques to raise the hydrocarbons from the second stage to the third stage For example, if the third sensor 141*c* of the second side chamber 132 detects the ball indicating that the second side chamber is full, the controller can use information from the first sensor 141*a* and second sensor 141*b* of the third side chamber 133 to determine if the second stage is full. For example, if the second side chamber 132 is full but the first sensor 141*a* of the third side chamber 133 detects the ball, the controller can determine that the second stage is not full. However, if the second side chamber 132 is full but the second sensor 141*b* of the third side chamber 133 detects the ball, the controller can determine that the second stage is full.

The techniques that the controller implements to lift the hydrocarbons from the second stage to the third stage are the same as those that the controller implemented to lift the hydrocarbons from the first stage to the second stage. For example, the controller transmits a signal to open the gas injection valve connected to the second stage. The gas injection valves connected to the other stages remain closed.

The valve that terminates the first stage prevents hydrocarbon flow in the downhole direction. The valve that terminates the second stage permits hydrocarbon flow in the uphole direction.

Figure 2F:
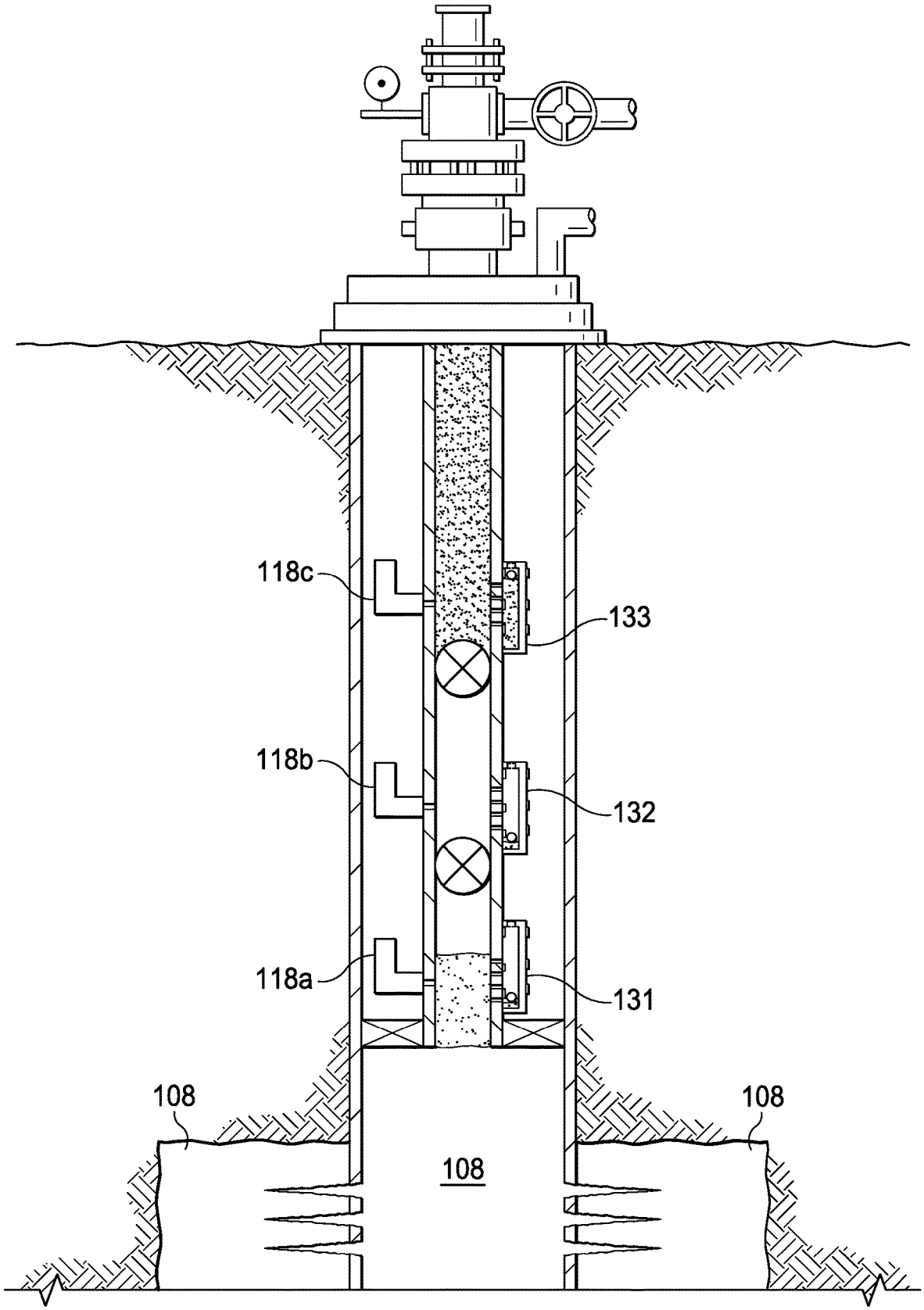
Figure 2G:
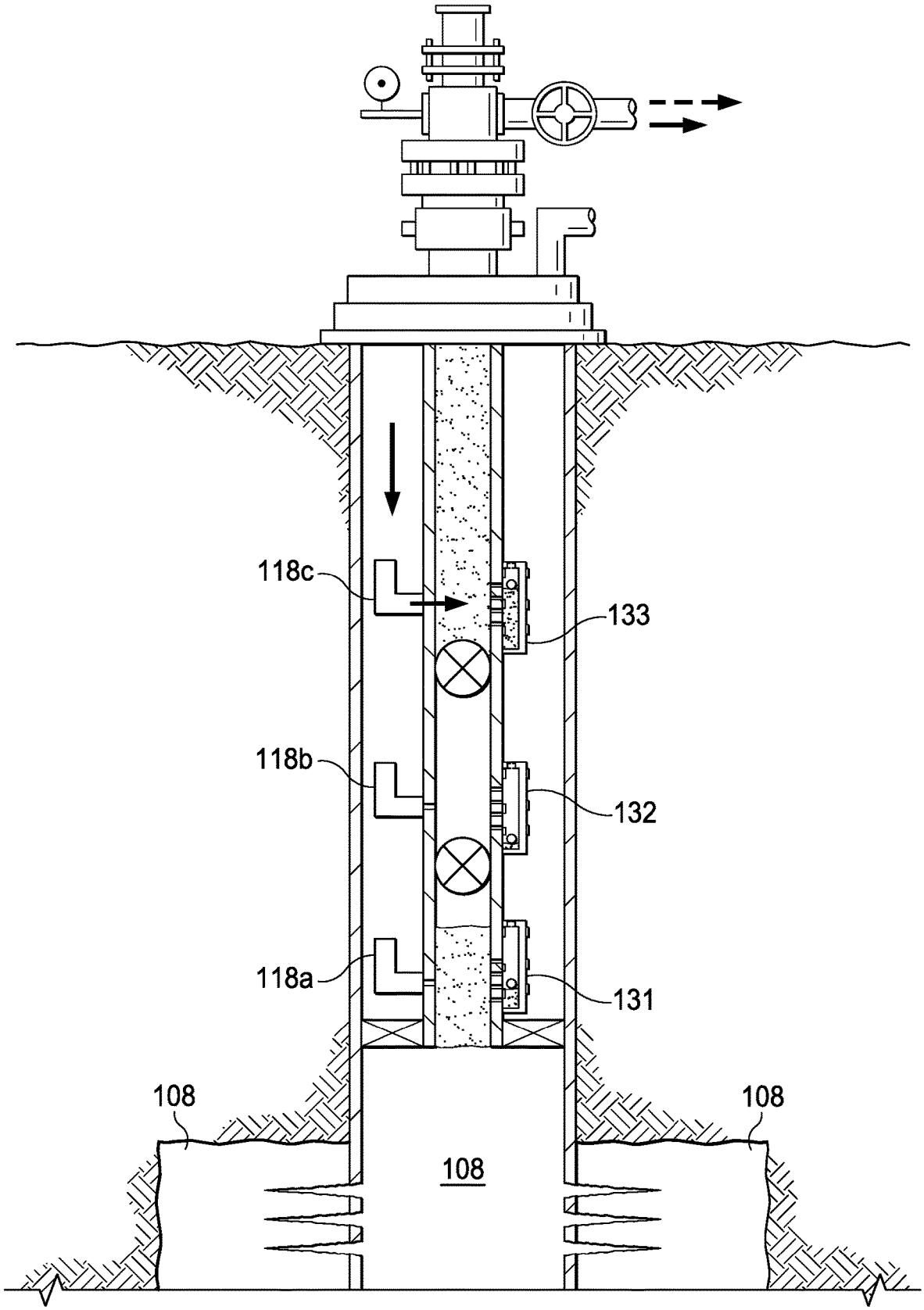
Figure 2H:
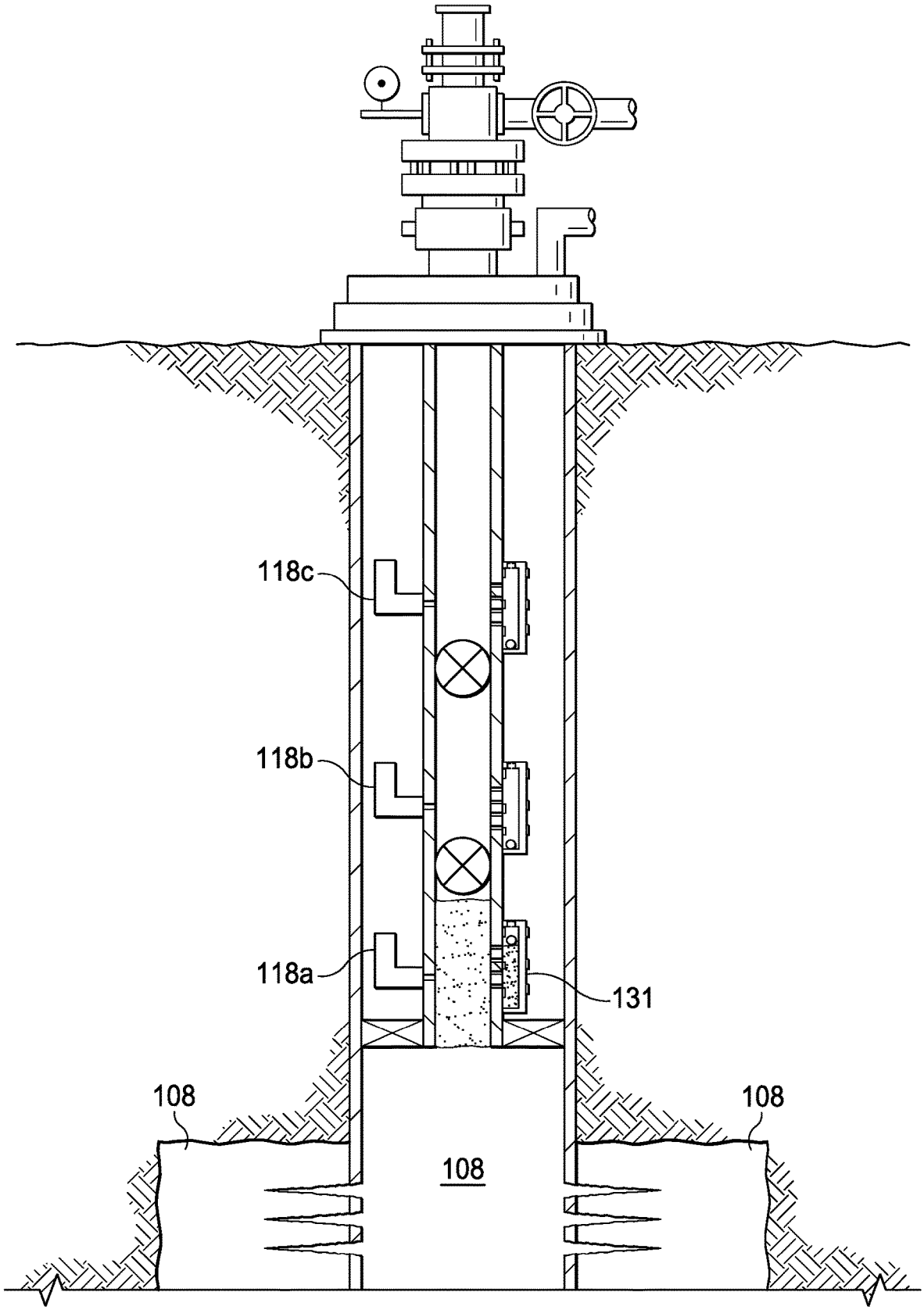

FIG. 2F shows hydrocarbons filled in the third stage. In the example wellbore tool system shown in FIG. 2F, the third stage is the most-uphole stage. FIG. 2G shows the hydrocarbons flowed uphole from the third stage to the surface, that is, out of the wellbore. FIG. 2H shows the hydrocarbons from the first stage having been lifted to the surface and out of the wellbore. FIG. 2H also shows that new hydrocarbons have flowed into and filled (completely or partially) into the first stage. The techniques described with reference to FIGS. 2A-2G are repeated to raise the hydrocarbons. In this manner, hydrocarbons are raised to the surface on a stage-by-stage basis.

In the example implementations described earlier, hydrocarbons were raised to the surface by injecting gas into only one stage at a time. That is, when gas was injected into the first stage, no gas was injected into the second or third stages. When gas was subsequently injected into the second stage, no gas was injected into the first or third stages. When gas was later injected into the third stage, no gas was injected into the first or second stages.

In some implementations, hydrocarbons can be raised to the surface by injecting gas into more than one stage at a time. For example, when the third stage is filled with hydrocarbons (FIG. 2F) and the controller determines that the first stage is filled with hydrocarbons, gas can be injected simultaneously into the first stage and the third stage. In such implementations, gas in more than one stage can be lifted simultaneously.

Figure 3:
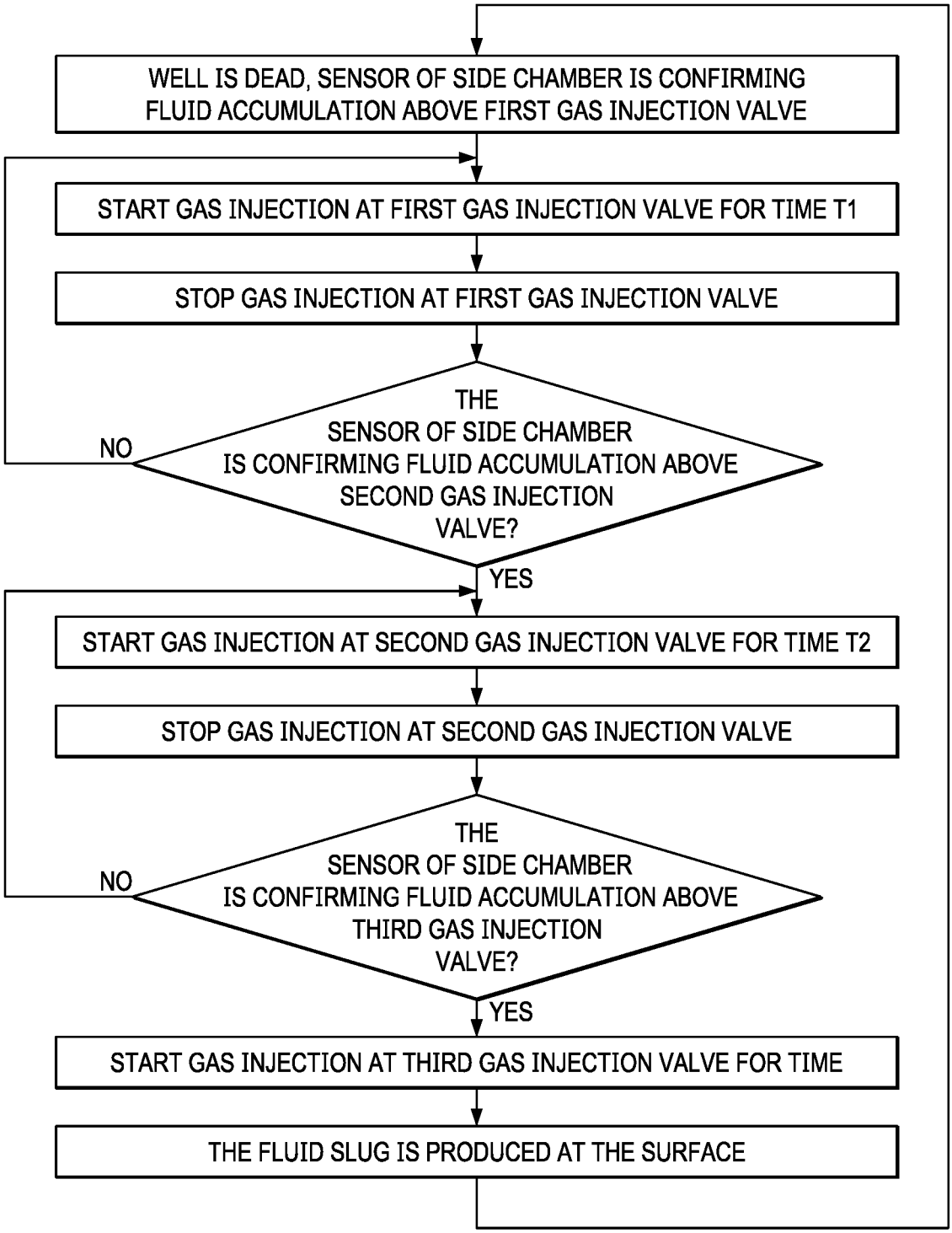
FIG. 3 is a flowchart of an example process to lift hydrocarbons.

FIG. 3 is a flowchart of an example process to lift hydrocarbons. The process can be implemented, for example, by the controller 126 described earlier. The process can be implemented when the well is dead, that is, the well has a low reservoir productivity index. In a first step, the controller determines that the first stage (that is, the most-downhole stage) is filled (completely or partially) with hydrocarbons from the subterranean zone. In a second step, the controller transmits a signal to inject gas into the first stage. For example, the controller can cause the gas to be injected for a time period sufficient to lift all the hydrocarbons in the first stage. In a third step, the controller stops injecting gas in the first stage. For example, the controller stops injecting the gas in the first stage after the time period or in response to a fluidic level in the first side chamber at the first stage falling below a threshold ore in the second stage increasing above a threshold (or any combination of them). In a fourth step, the controller checks if the second stage is filled with hydrocarbons. If not, then the controller continues to inject gas into the first stage. If yes, then, in a fifth step, the controller transmits a signal to inject gas into the second stage. In a sixth step, the controller stops injecting gas in the second stage. In a seventh step, the controller checks if a third stage is filled with hydrocarbons. If not, then the controller continues to inject gas into the second stage. If yes, then, in an eighth step, the controller transmits a signal to inject gas into the third stage. In a ninth step, the controller stops injecting gas in the third stage. Because the third stage is the most-uphole stage in this example, in a tenth step, the hydrocarbons that accumulated in the first stage are produced at the surface. The controller repeats the steps of the process to produce the next volume of hydrocarbons that have accumulated in the first stage.

Although the detailed description herein contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that the mere use of the term "first" and "second" does not require that there be any "third" component, although that possibility is contemplated under the scope of the present disclosure.

The invention claimed is:

1. A method comprising:

in a production tubing disposed in a wellbore formed in a subterranean zone, the production tubing extending from a surface of the wellbore to a downhole location in the wellbore at which hydrocarbons entrapped in the subterranean zone enter the wellbore, a plurality of valves disposed in the production tubing at a respective plurality of tubing locations, each valve of the plurality of valves configured to permit one-way flow of hydrocarbons in an uphole direction, wherein the plurality of valves divide the production tubing into a plurality of stages, each stage defined either (i) between two successive valves of the plurality of valves, or (ii) between one of the plurality of valves and an end of the production tubing:

(a) determining a presence of hydrocarbons in a first stage terminating at a first valve of the plurality of valves;

(b) in response to determining the presence of hydrocarbons in the first stage, injecting gas into the first stage causing the hydrocarbons in the first stage to flow uphole through the first valve into a second stage uphole of the first stage, the second stage terminating at a second valve of the plurality of valves;

(c) determining that the second stage is filled with the hydrocarbons flowed uphole through the first valve from the first stage; and (d) in response to determining that the second stage is filled with the hydrocarbons, ceasing to inject the gas into the first stage;

wherein a plurality of side chambers are disposed in the respective plurality of stages, each side chamber fluidically coupled to a respective stage and configured to receive hydrocarbons from the respective stage, each side chamber comprising one or more sensors coupled to the side chamber, and determining the presence of hydrocarbons in the first stage comprises detecting, by at least one of 1) a first sensor coupled to a first side chamber at the first stage or 2) a second sensor coupled to a second side chamber at the second stage, a fluidic level of the hydrocarbons inside the first side chamber or a fluidic level of the hydrocarbons inside the second side chamber, respectively, and wherein each stage comprises a side wall of the production tubing and each side chamber comprises a pocket extending from the side wall, each pocket defining a volume between the side wall and a wall of the pocket, the side wall comprising one or more fluid ports defining a fluid pathway from the respective stage to the pocket, each pocket fluidically isolated from a wellbore annulus around the pocket, and injecting gas into the first stage comprises injecting gas into the first stage causing the hydrocarbons in the first stage to flow uphole through the first valve into the second stage and into a volume of a second pocket of the second stage.

2. The method of claim 1, further comprising:

(e) in response to determining that the second stage is filled with the hydrocarbons, injecting gas into the second stage causing the hydrocarbons in the second stage to flow uphole through the second valve into a third stage uphole of the second stage, the third stage terminating at a third valve of the plurality of valves;

(f) determining that the third stage is filled with the hydrocarbons flowed uphole through the second valve from the second stage; and (g) in response to determining that the third stage is filled with the hydrocarbons, ceasing to inject the gas into the second stage.

3. The method of claim 1, wherein the one or more sensors comprise a first plurality of sensors coupled to the first side chamber that is fluidically coupled to the first stage, each sensor of the first plurality of sensors spaced along a length of the first side chamber, a first sensor of the first plurality of sensors configured to detect a first fluidic level of the hydrocarbons in the first side chamber, and a last sensor of the first plurality of sensors configured to detect a second fluidic level of the hydrocarbons in the first side chamber greater than the first fluidic level, and determining the presence of hydrocarbons in the first stage comprises detecting, by the last sensor, the second fluidic level of the hydrocarbons in the first side chamber.

4. The method of claim 3, wherein determining a presence of hydrocarbons in the first stage comprises determining that the first stage is full with hydrocarbons, and determining that the first stage is full with hydrocarbons comprises detecting, by the last sensor, the second fluidic level of the hydrocarbons in the first side chamber.

5. The method of claim 1, wherein each pocket comprises a floater disposed inside the respective volume and configured to float on a surface of hydrocarbons inside the volume, and detecting a fluidic level of the hydrocarbons inside the first side chamber or a fluidic level of the hydrocarbons inside the second side chamber comprises detecting a presence of the floater.

6. The method of claim 1, wherein injecting the gas into the first stage comprises injecting the gas for a first duration of time sufficient to flow the hydrocarbons in the first stage uphole through the first valve into the second stage and the second side chamber of the second stage.

7. The method of claim 1, wherein determining that the second stage is filled with the hydrocarbons flowed uphole through the first valve from the first stage comprises determining a presence of hydrocarbons in a third stage uphole of the second stage and terminating at a third valve of the plurality of valves.

8. The method of claim 7, wherein a third side chamber is disposed in the third stage uphole of the second valve, and wherein determining the presence of hydrocarbons in the third stage comprises detecting, by at least one sensor of the one or more sensors and disposed at the third side chamber, a fluidic level inside the third side chamber caused by hydrocarbons flowed from the second stage through the second valve into the third stage.

9. A wellbore tool assembly comprising:

a production tubing disposed in a wellbore formed in a subterranean zone, the production tubing extending from a surface of the wellbore to a downhole location in the wellbore at which hydrocarbons entrapped in the subterranean zone enter the wellbore;

a plurality of valves disposed in the production tubing at a respective plurality of tubing locations, each valve of the plurality of valves configured to permit one-way flow of hydrocarbons in an uphole direction, wherein the plurality of valves divide the production tubing into a plurality of stages, each stage defined either (i) between two successive valves of the plurality of valves, or (ii) between one of the plurality of valves and an end of the production tubing;

a plurality of side chambers disposed in the respective plurality of stages, each side chamber fluidically coupled to a respective stage and configured to receive hydrocarbons from the stage, each side chamber comprising one or more sensors coupled to the side chamber and configured to detect a fluidic level of the hydrocarbons in the respective side chamber;

a plurality of gas injection valves coupled to the production tubing, each gas injection valve disposed in a respective stage; and a controller coupled to the plurality of gas injection valves, the controller configured to transmit signals, based on fluidic levels detected by the one or more sensors, to the plurality of gas injection valves to lift hydrocarbons flowed into the wellbore at the downhole location to the surface on a stage-by-stage basis;

wherein each stage comprises a side wall of the production tubing and each side chamber comprises a pocket extending from the side wall, each pocket defining a volume between the side wall and a wall of the pocket, the side wall comprising one or more fluid ports defining a fluid pathway from the respective stage to the pocket, each pocket fluidically isolated from a wellbore annulus around the pocket, the gas injection valves controllable to inject gas into the first stage, causing the hydrocarbons in the first stage to flow uphole through the first valve into the second stage and into a volume of a second pocket of the second stage.

10. The wellbore tool assembly of claim 9, wherein, to lift the hydrocarbons to the surface on the stage-by-stage basis, the controller is configured to perform operations comprising:

(a) determining, based on fluid level information received from at least one of 1) a first sensor of the one or more sensors residing at a first side chamber of a first stage terminating at a first valve of the plurality of valves or 2) a second sensor of the one or more sensors residing at a second side chamber of a second stage extending from the first valve to a second valve of the plurality of valves, a presence of hydrocarbons in the first stage;

(b) in response to determining the presence of hydrocarbons in the first stage, injecting gas into the first stage causing the hydrocarbons in the first stage to flow uphole through the first valve into the second stage uphole of the first stage, the second stage terminating at the second valve;

(c) determining that the second stage is filled with the hydrocarbons flowed uphole through the first valve from the first stage; and (d) in response to determining the presence of hydrocarbons in the second stage, ceasing to inject gas into the first stage.

11. The wellbore tool assembly of claim 10, wherein determining the presence of hydrocarbons in the first stage comprises:

receiving, by the controller and from the first sensor, fluidic information comprising a first fluidic level of the hydrocarbons in the first side chamber, the fluidic information detected by a last sensor of a group of sensors attached to the first side chamber; and receiving, by the controller and from the second sensor, fluidic information comprising second fluidic level of the hydrocarbons in the second side chamber.

12. The wellbore tool assembly of claim 10, wherein injecting the gas into the first stage comprises injecting the gas for a first duration of time sufficient to flow the hydrocarbons in the first stage uphole through the first valve into the second stage and into the second side chamber.

13. The wellbore tool assembly of claim 10, wherein determining that the second stage is filled with the hydrocarbons flowed uphole through the first valve from the first stage comprises determining a presence of hydrocarbons in a third stage uphole of the second stage and terminating at a third valve of the plurality of valves.

14. The wellbore tool assembly of claim 13, wherein a third side chamber is disposed in the third stage uphole of the second valve, and wherein determining the presence of hydrocarbons in the third stage comprises detecting, by a sensor attached to the third side chamber, a fluidic level of hydrocarbons inside the third side chamber flowed from the second stage through the second valve into the third stage.

15. A method comprising:

in a production tubing disposed in a wellbore formed in a subterranean zone, the production tubing extending from a surface of the wellbore to a downhole location in the wellbore at which hydrocarbons entrapped in the subterranean zone enter the wellbore, a plurality of valves disposed in the production tubing at a respective plurality of tubing locations, each valve of the plurality of valves configured to permit one-way flow of hydrocarbons in an uphole direction, wherein the plurality of valves divide the production tubing into a plurality of stages, each stage defined either (i) between two successive valves of the plurality of valves, or (ii) between one of the plurality of valves and an end of the production tubing, determining, based on a fluidic level of hydrocarbons detected by a first sensor coupled to a first side chamber coupled to the production tubing at a first stage of the plurality of stages, that the hydrocarbons are carried by the first stage;

injecting gas into the first stage, causing the hydrocarbons to flow into a second stage uphole of the first stage;

ceasing to inject the gas into the first stage in response to determining that the hydrocarbons flowed to the second stage; and after ceasing to inject the gas into the first stage, injecting gas into the second stage causing the hydrocarbons to flow into a third stage uphole of the second stage;

wherein each stage comprises a side wall of the production tubing and each side chamber comprises a pocket extending from the side wall, each pocket defining a volume between the side wall and a wall of the pocket, the side wall comprising one or more fluid ports defining a fluid pathway from the respective stage to the pocket, each pocket fluidically isolated from a wellbore annulus around the pocket, and injecting gas into the first stage comprises injecting gas into the first stage causing the hydrocarbons in the first stage to flow uphole through the first valve into the second stage and into a volume of a second pocket of the second stage.

16. The method of claim 15, further comprising, before ceasing to inject gas into the first stage, determining, by at least one of 1) a second sensor coupled to a second side chamber coupled to the production tubing at a second stage of the plurality of stages or 2) a third sensor coupled to a third side chamber coupled to the production tubing at a third stage of the plurality of stages, a second fluidic level of the hydrocarbons in the second side chamber or a third fluidic level of the hydrocarbons in the third side chamber.

17. The method of claim 15, further comprising preventing a flow back of the hydrocarbons from the second stage to the first stage after ceasing to inject the gas into the first stage.

18. The method of claim 17, wherein a first valve of the plurality of valves at which the first stage terminates prevents the flow back of the hydrocarbons from the second stage to the first stage.

19. The method of claim 15, further comprising injecting gas into the plurality of stages on a stage-by-stage basis to flow the hydrocarbons to the surface of the wellbore.

* * * * *